US007146914B2

(12) United States Patent
Morton et al.

(10) Patent No.: US 7,146,914 B2
(45) Date of Patent: Dec. 12, 2006

(54) IDENTITY PRESERVED CONTAINER

(76) Inventors: William R. Morton, 5583A Meredith Dr., Des Moines, IA (US) 50310; James W. Osterson, 5583A Meredith Dr., Des Moines, IA (US) 50310

( * ) Notice: Subject to any disclaimer, the term of this patent is extended or adjusted under 35 U.S.C. 154(b) by 10 days.

(21) Appl. No.: 10/733,030

(22) Filed: Dec. 11, 2003

(65) Prior Publication Data

US 2005/0126425 A1 Jun. 16, 2005

(51) Int. Cl.
*B61D 3/00* (2006.01)
*B61D 7/00* (2006.01)

(52) U.S. Cl. ..... 105/247

(58) Field of Classification Search ..... 105/238.1, 105/239, 247, 404, 406.1, 409, 248
See application file for complete search history.

(56) References Cited

U.S. PATENT DOCUMENTS

| | | | | |
|---|---|---|---|---|
| 2,989,008 | A | 6/1961 | Lindstrom | |
| 3,997,089 | A | 12/1976 | Clarke et al. | |
| 4,009,907 | A | 3/1977 | Stanfill | |
| 4,168,665 | A | 9/1979 | Needham et al. | |
| 4,230,048 | A | 10/1980 | Gordon et al. | |
| 4,378,078 | A | 3/1983 | Daniels | |
| 4,394,096 | A | 7/1983 | Stevens | |
| 4,528,783 | A | 7/1985 | Muir | |
| 4,541,765 | A | 9/1985 | Moore | |
| 4,867,073 | A | 9/1989 | Dugge | |
| 5,064,237 | A | 11/1991 | Cline | |
| 5,312,162 | A * | 5/1994 | Baebel | 298/1 B |
| 5,480,018 | A | 1/1996 | Sasaki | |
| 5,624,049 | A | 4/1997 | Kovash et al. | |
| 6,363,863 | B1 * | 4/2002 | Dohr | 105/247 |

* cited by examiner

*Primary Examiner*—S. Joseph Morano
*Assistant Examiner*—Robert J. McCarry, Jr.
(74) *Attorney, Agent, or Firm*—Daniel A. Rosenberg; Kent A. Herink; Emily E. Harris

(57) ABSTRACT

An identity preserved container for storage, transportation, and segregation of a flowable cargo is provided. The container comprises a frame supporting an enclosure with a top, bottom, side walls, front wall, and a back wall. A liner is provided and secured to an interior of the enclosure, comprising side panels and funnels panels forming a bin terminating in a centrally located opening in said bottom of the enclosure. The container also includes a belly door located in the opening in the bottom of the enclosure wherein the belly door moves between a closed and an open position.

23 Claims, 4 Drawing Sheets

IDENTITY PRESERVED CONTAINER

BACKGROUND OF THE INVENTION

The present invention relates to an identity preserved ("IP") container. In particular, to an IP container with a frame supporting an enclosure with a liner forming a bin terminating in a centrally located belly door.

Recent advances in biotechnology have revolutionized the agricultural industry, and in particular grain production. The proliferation of a wide variety of bio-engineered and genetically modified crops and food products provides unprecedented opportunity for farmers to achieve larger profit margins though production of niche products, especially compared to the economics of traditional grain products. Realization of the profits associated with these specialty grains, however, requires identify preservation of the grain throughout the distribution chain. In other words, from the farm to the factory the specialty or IP grain cannot co-mingle with other grains if the farmer expects the end users to pay a premium for the product.

In addition, with regard to genetically modified organisms ("GMO") certain jurisdictions ban the importation of GMO crops, or limit the use of the crops in a manner that requires segregation of GMO grains from other grains.

As the technology of bio-engineering continues to evolve grain products the trend toward specialty grains will continue to grow, which will continue to transform what once was a fungible commodity into a product that requires special handling and segregation.

The traditional distribution methods applied to grains simply do not accommodate IP grains. At nearly every step of the established process grain is co-mingled. For example, during harvest, wagons or trucks offload the grain from the harvester for transportation to a local community grain elevator. In many cases, the wagons or trucks may contain grain from other sources, and almost certainly contain grain dust or pollen from other sources. Furthermore, the elevators handle large quantities of grain from over a fairly large region. Next, the elevator typically dispenses the grain to a larger truck or railcar for further transportation. For overseas transportation the grain is loaded into very large cargo holds of ships with grain from throughout the country. At each of these steps, substantial co-mingling takes place in a manner that makes IP movement completely impossible.

Containerization comprises one transportation option that that has greatly reduced the time and costs of shipping products over great distances, but heretofore has not been adopted for transportation of grains. Until the mid-1960s, cargo traveling by truck, rail, and ship traveled in essentially a haphazard and random manner. The lack of standardization made shipping cargo expensive and labor intensive. The introduction of standardized shipping containers, facilitated by the development of pallets and modem fork lifts, made it possible to greatly decrease the time and costs involved in shipping all types of cargo, including small items and delicate cargo. The development of intermodal containers made it possible to use one standard sized container to ship cargo by rail, truck, and by ship. The containers are large and can thus carry large amounts of cargo, they can be stacked, and can be moved from one transportation type to another without the need for disturbing the underlying cargo. In addition, the containers can be sealed to protect the cargo from contamination, and from other associated hazards. Thus, the proliferation of standardized containers has dramatically improved the art of cargo transportation.

Traditional standardized containers, however, are not particularly well suited for the transportation of grains, and transportation of IP grains in particular. Typically, the containers are side or end loaded and due to the fact that grain by its nature is a flowable material, this makes loading difficult. Furthermore, unloading grain is also difficult. The container must be tipped so that the grain can flow out of the side or end doors, and even this will not remove all of the grain and/or pollen from the container. Thus, shipment of IP grains in conventional standardized containers would require cleaning and decontamination of the containers before each reuse.

Accordingly, a need exists for a convenient transportation device that preserves the identity of the product or substance transported.

SUMMARY OF THE INVENTION

An object of the present invention comprises providing an IP container for transportation, storage, and segregation of a flowable cargo.

These and other objects of the present invention will become apparent to those skilled in the art upon reference to the following specification, drawings, and claims.

The present invention intends to overcome the difficulties encountered heretofore. To that end, an IP container for storage of a flowable cargo is provided. The container comprises a frame supporting an enclosure with a top, bottom, side walls, front wall, and back wall. A liner is provided and secured to an interior of the enclosure, comprising side panels and funnels panels forming a bin terminating in a centrally located opening in said bottom of the enclosure. The container also includes a belly door located in the opening in the bottom of the enclosure wherein the belly door moves between a closed and an open position.

DETAILED DESCRIPTION OF THE INVENTION

Figure 1:
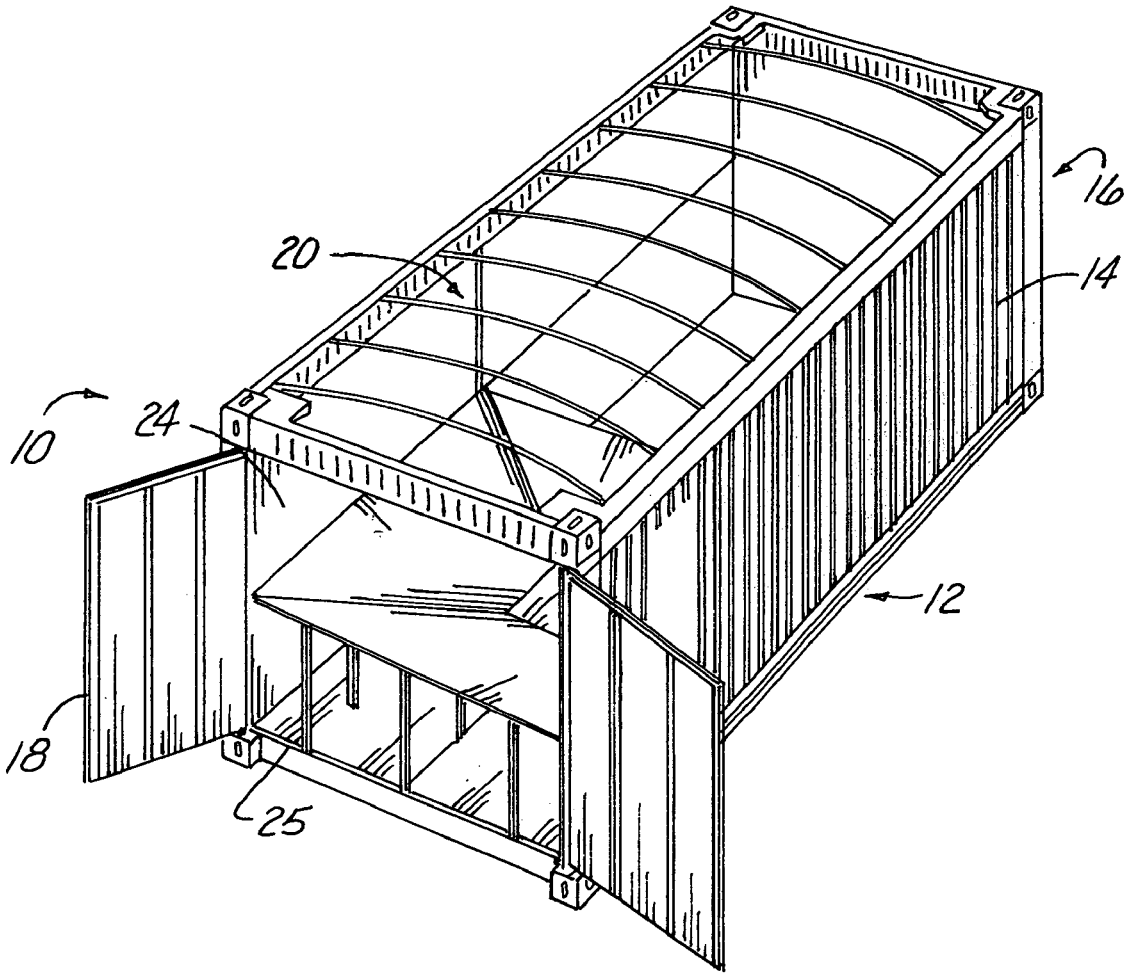
FIG. 1 is a perspective view of an IP container.

In the Figures, FIG. 1 shows an IP container 10 that consists of a modified standardized intermodal container. The dimensions and construction of standard containers are well known in the art. In the preferred embodiment of the invention the container is 6058 mm×2500 mm×2591 mm (length×width×height) in external dimension, and 5880 mm×2420 mm×2387.5 mm in internal dimensions. This inner cubic capacity is 34 $m^3$. Of course, these dimensions can and will vary depending on the application. In the preferred embodiment of the invention the IP container 10 is manufactured from an existing container, however, those of ordinary skill in the art will understand that the invention is not so limited. In particular, the IP container 10 could be specifically manufactured in a manner that would eliminate the need for modification.

The IP container 10 includes a bottom 12, side walls 14, back wall 16, doors 18, and a top 20. In the preferred embodiment of the invention the doors 18 are welded shut to preserve an airtight inner storage cavity. The interior of the IP container 10 includes a lining that takes the general form of a funnel bin. In particular, the lining includes tapered funnel panels 22 supported by a plurality of funnel braces 25. The funnel panels 22 form an angle 23 of forty-five degrees (see FIG. 6). The liner includes side panels 24. The liner is constructed of polyboard, or other similar type no-stick material. Polyboard is commercially available from commercial suppliers like McMasters-Carr of Elmhurst, Ill., and is typically made of sheets of polypropylene.

Figure 6:
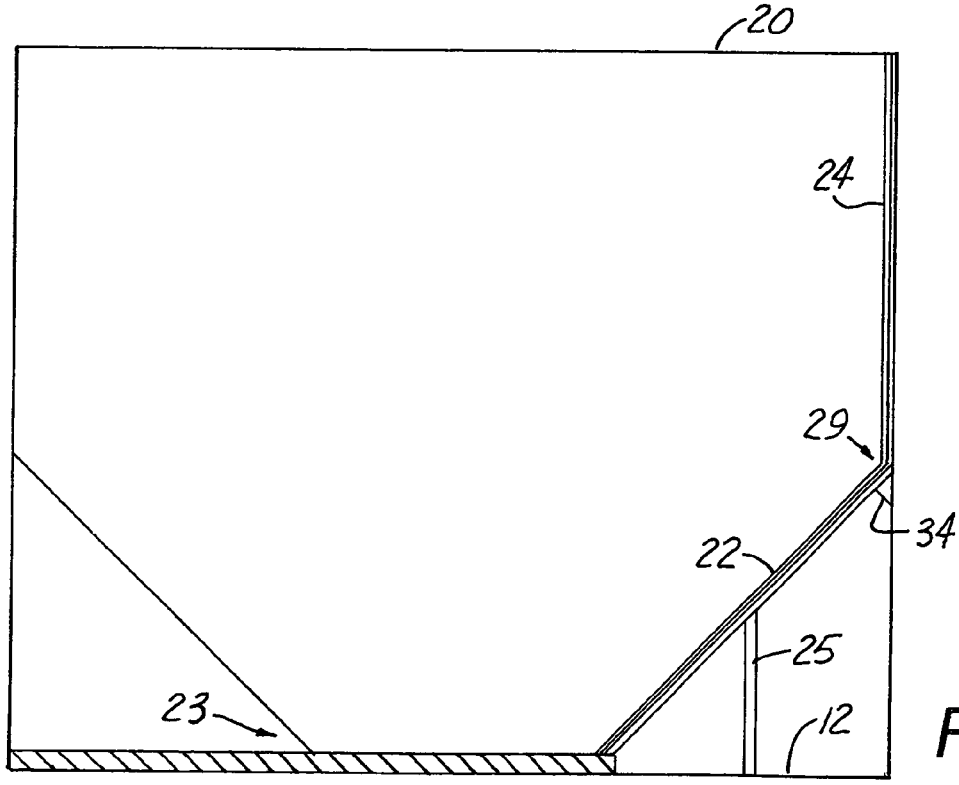
FIG. 6 is a side view of a liner of the IP container.
Figure 7:
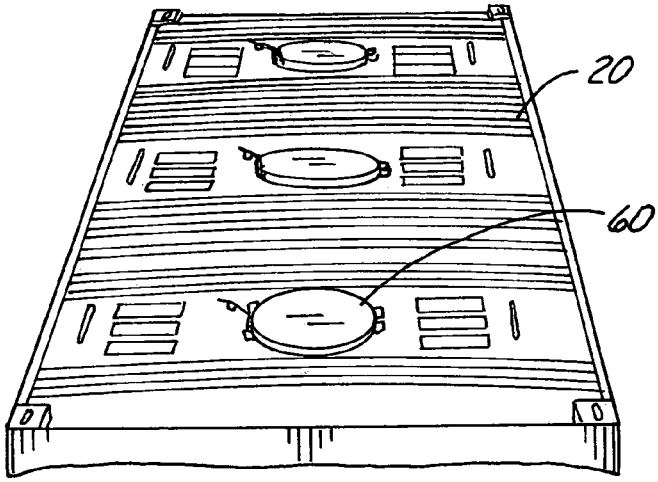
FIG. 7 is a perspective view of a top of the IP container.

FIG. 6 shows the joint between the side panels 24 and the funnel panels 22. The funnel panels 22 are supported with funnel braces 25 and with angle brackets 34. In addition, angle brackets 34 support the joint between the side panels 24 and the funnel panels 22. The side panels 24 terminate at a tapered side panel joint end 27 the meets the funnel panels 22 flush. The joint between the side panels 24 and the funnel panels 22 is then poly extrusion welded in place. In this manner, the joint between the side panels 24 and the funnel panel 22 will prevent cargo from inadvertently logging in the joint between the panels 24, 22.

Figure 4:
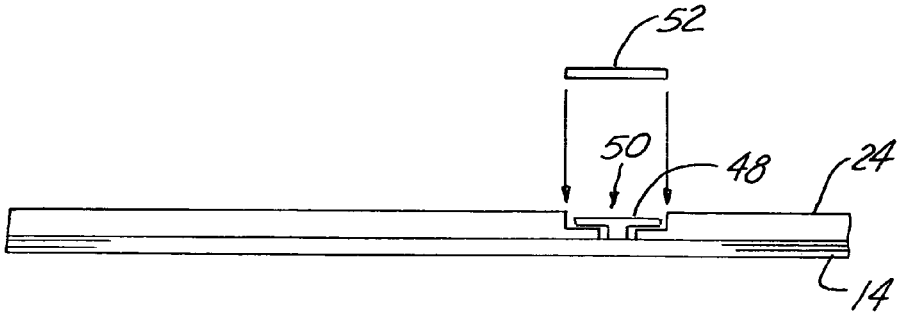
FIG. 4 is a side view of a side panel and fastener.

FIG. 4 depicts the method of attaching the side panels 24 to the side walls 14 of the IP container 10. A metal fastener 48 is attached to the side wall 14 with weldments, or similar attachment means, wherein the head of the fastener 48 is captured within a recess 50 in the side panel 24. A poly cap 52 is secured over the recess 50 and poly extrusion welded in place to maintain a non-stick surface on the side panel 24 to prevent inadvertent capture of any portion of the IP container 10 cargo. The side panels 24 are attached to the side walls 14 of the IP container 10 at regularly spaced intervals to provide for secure attachment.

Figure 2:
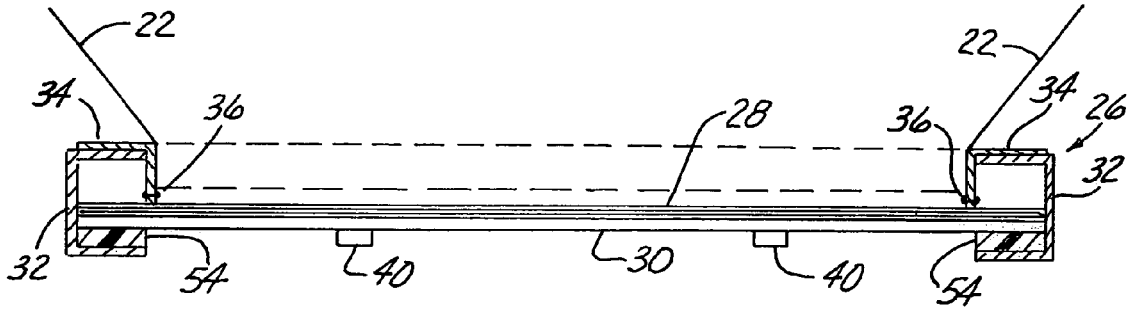
FIG. 2 is a side view of a belly door of the IP container.
Figure 3:
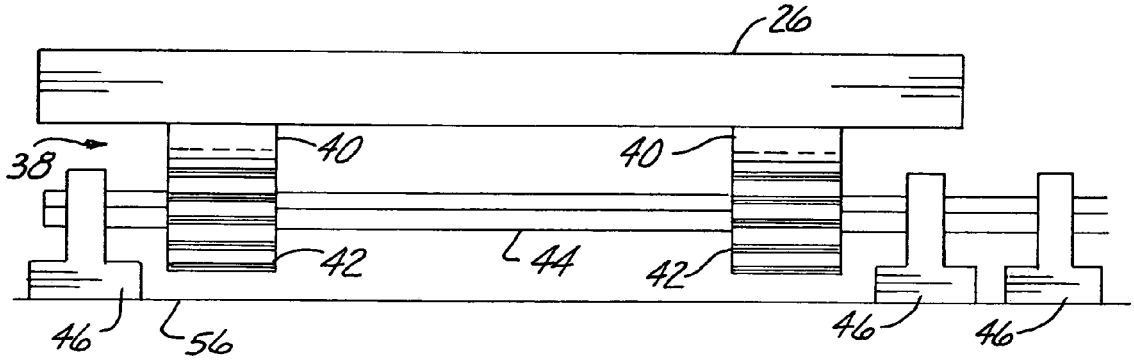
FIG. 3 is a side view of a rack and spur mechanism for moving the belly door.

FIGS. 2 and 3 depict the belly door 26 that lies at the bottom of the funnel formed by the funnel panels 22. The belly door 26 lies in a 3'×2' opening in the center of the bottom 12 of the IP container 10. The belly door 26 comprises a first plate 28 made of ½" thick poly board and a second plate 30 made of ¼" steel. A channel 32 runs the length of two opposing sides of the belly door 26. The belly door 26 moves between a closed and an open position by moving in the channel 32. Angle brackets 34 attach to the top and inside portions of the channel 32 to form a joint between the first plate 28 and funnel plates 22. Rubber seals 36 runs the length of the channels 32 between the first plates 28 and the bottom of the angle brackets 34 to prevent cargo from collecting in the channel 32. Slats 54 made of polyboard fit between the second plates 30 and the bottom of the channels 32 to capture the lower portion of the belly door 26. The area between the inward sections of the angle brackets 34 form a well 1¾" deep. In addition, the belly door 26 includes opposing racks 40 that run the length of the underside of the belly door 26, for use in moving the belly door 26 between a closed and open position.

FIG. 3 shows the mechanism 38 for moving the belly door 26. The mechanism 38 includes spur gears 42 aligned with the racks 40, which connect to a shaft 44. The shaft 44 is captured by pillow bearings 46. Two of the pillow bearings 46 attach under the belly door 26 to a portion of bracing 56 that runs along the bottom 12 of the IP container 10. The other pillow bearing attached to an end of the bracing 56 near toward an outside edge of the bottom 12 of the IP container 10. A crank (not shown) attaches to the shaft 44 at the outside edge to allow for manually moving the belly door by rotating the crank. The belly door 26 is sized to fit between adjacent brace member 56 of the IP container, and moves in a direction perpendicular to the brace members 26.

Figure 5:
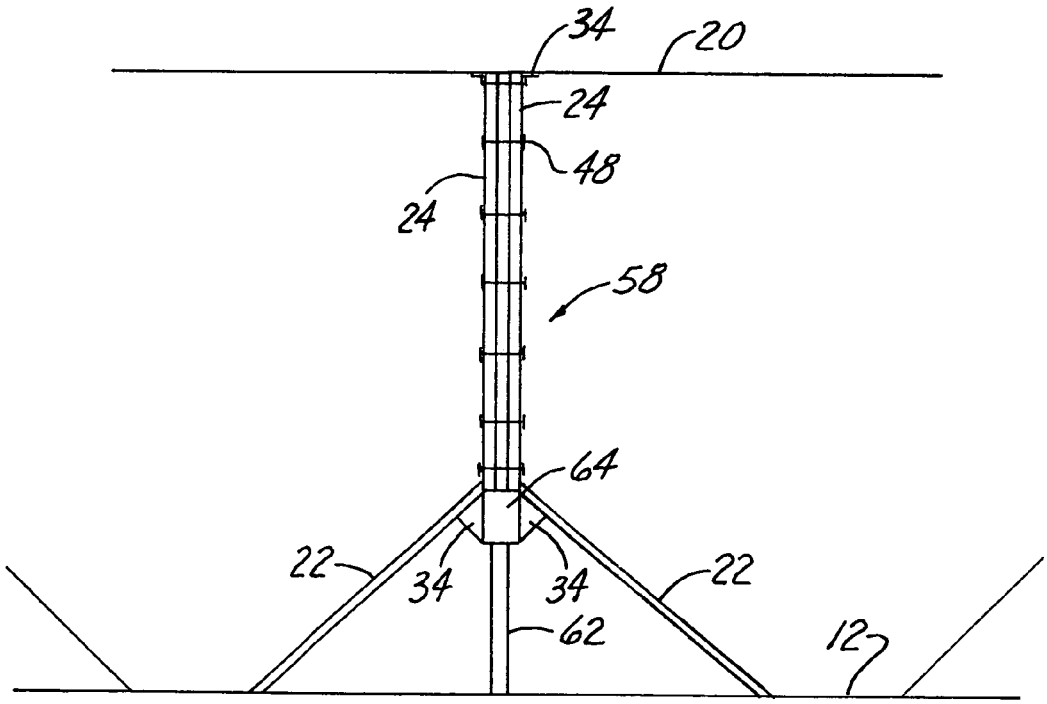
FIG. 5 is a side view of a compartment wall.

FIG. 5 shows an embodiment of the invention that utilizes a compartment wall 58 located within the interior of the IP container 10. The compartment wall 58 creates a partition to allow for segregating the IP container 10 into a plurality of sections. The compartment wall 58 comprises a liner essentially identical to the liner described hereinabove, except that the three liner panels 24 attach to each other with fasteners 48 to form the compartment wall 58. The compartment wall 58 components are also comprised of polyboard. A piece of rectangular tubing 64 supports the compartment wall 58 above a plurality of support braces 62 placed along and under the rectangular tubing 64. Angle brackets 34 provide support at the joint between the side panels 24 and the funnel panels 22, and at the transition between the top of the compartment wall 58 and the top 20 of the IP container 10. Each compartment or section created by the compartment wall(s) 58 would include its own belly door 26.

The top 20 of the IP container 10 includes a plurality of sealable hatches 60 through which cargo enters the IP container 10. The top 20 creates an airtight seal in the IP container 10, except for opening the hatches 60 and belly doors 26.

In the preferred embodiment of the invention a conventional intermodal standardized container is converted into the IP container 10 according to the following method. The first step involves removing the floor of the container, typically made of plywood, to expose the bottom bracing including the center brace. A hole for the hatch is cut in the top, wherein each compartment includes one hatch located directly over the center of each compartment. Working from the back compartment forward toward the container doors, the belly door is located in the bottom center of each compartment. The belly door channels are welded in place to the existing center most braces in each compartment. The remainder of the belly door is then constructed between the channels. The mechanism for moving the belly door is then constructed by aligning the spur gears with the rack welded to the bottom of the belly door. The pillow bearings are then placed in the manner shown and described hereinabove. A 2" hole can be placed in the lower portion of the side wall to allow for inserting the crank onto the shaft for moving the belly door.

Next, the liner is constructed. Measuring the distance from the edge of the belly door to the walls comprises an easy method for determining the length of the funnel panels, in that this distance is the same as the length of two sides of a right triangle, of which the funnel panels forms the hypotenuse. This will ensure a forty-five degree angle. This distance is marked on the side walls of the container, and angle brackets are welded to the side walls in the orientation shown in FIG. 6. The funnel braces are then placed on the bottom of the container, angle brackets can be used to support the bottom of the braces. The funnel panels and side panels can then be cut and secured in place. Compartment walls are then constructed by first welding 2"×2" angle brackets to the 3"×1" rectangular tubing at regular spaced intervals, as shown in FIG. 5. The rectangular tubing is then welded to the side walls of the container at the appropriate height, and supported by three support braces. The funnel panels can be put in place on the various compartments, this will allow for assembly of the three piece center compartment walls from the back of the container to the front. Prior to placing the center compartment walls in place, 2"×2" angle brackets are welded to the each side wall and top of the container to allow for mounting the upper corners of the center compartment walls. The angle brackets include pre-drilled holes for this purpose, this allows for using stainless steal bolts to mount the center compartment walls to the angle brackets. Additional side panels and funnel panels are attached to each compartment in the manner described above. The final step in the process is to enter the container from the open belly door and extrusion weld all of the seams. The container doors, if not already sealed, can be sealed at this time as well.

Configured in this manner, the IP container comprises an airtight self-contained transportation device suitable for moving cargo that requires complete segregation. In particular, the IP container is preferably designed for the transportation of IP grains like corn, soybeans, wheat, sorghum, rice and the like, and for processed material such as sugar. The top-loading hatch makes for convenient loading of flowable material like grains, and the belly door allows for easy unloading of the same substances. The very slick surfaces of the liner allows the cargo to flow out of the interior of the IP container on unloading, and the special construction prevents the retention of even small amounts of the cargo. This substantially eliminates the need for special cleaning and sterilization of the IP container between uses. The IP container is airtight, which allows for loading cargo in a specified moisture condition and maintaining that condition until the cargo arrives at its destination. Once the cargo is loaded into the IP container, it is sealed and not disturbed until it arrives at its ultimate destination. In this manner, the problems associated with prior art transportation systems is substantially eliminated, especially as those problems relate to cargo that requires identity preservation.

Figure 8:
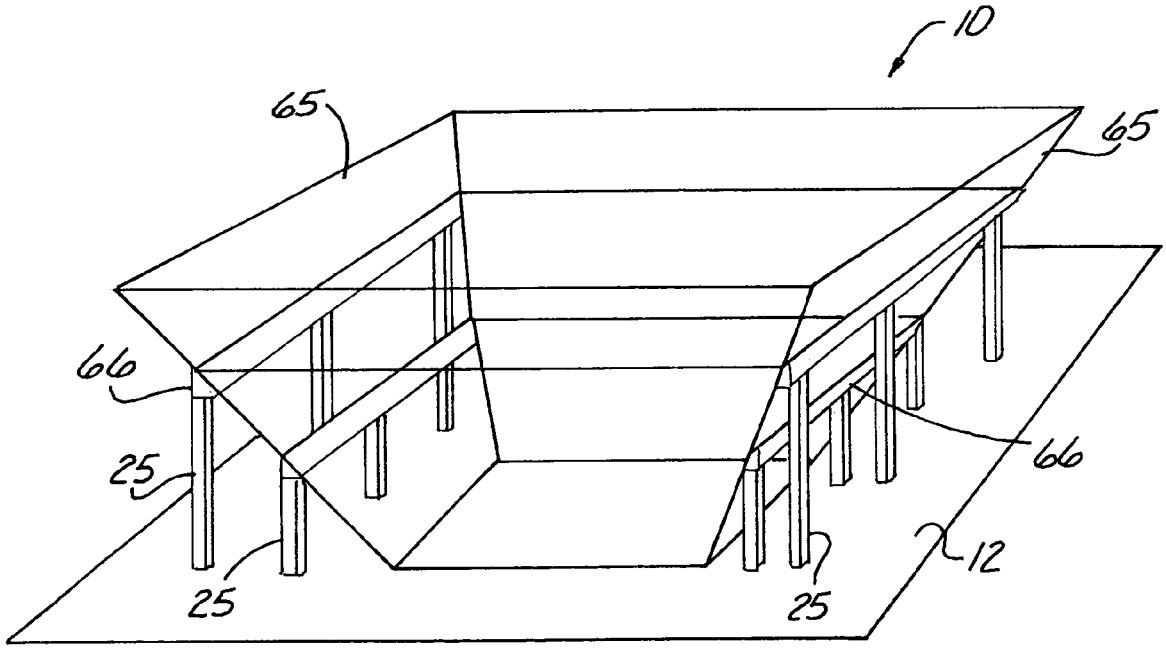
FIG. 8 is a prospective view of an uncovered IP container illustrating the attachment of angle iron frame and square tubing supports to an underlying lawyer of steel reinforcement funnel panels.

FIG. 8 shows a perspective view the uncovered IP container 10. In this embodiment of the invention, the inner storage cavity of the container 10 includes four steel reinforcement support panels 65. The support panels 65 are made of ¼" steel plate that fasten and reinforce and support the underside of the poly board funnel panels 22 located inside the container 10. The funnel panels 22 can be made of any commercially available thermoplastics such as polypropylene and ABS that are tough and impact resistant. Two rows of 2"×2"×¼" angle iron frame 66 that run the length of the each of the support panels 65 are attached generally in the middle of the each of the support panels 65. The joint between the suport panels 65 is poly extrusion welded in place. The angle iron frame 66 is similarly welded to the support panels 65 to form a stable entity. The support panels 65 are secured to the floor 12 of container 10 by a plurality of vertically orientated square tubing supports 25. The 2"×2"×⅛" square tubing supports 25 vertically extend from the floor 12 of container 10 to connect with the angle iron frame 66. Three evenly spaced square tubing supports 25 are connected along the side of each support panel 65 to the angle iron frame 66.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art that have the disclosure before them will be able to make modifications and variations therein without departing from the scope of the invention.

The invention claimed is:

1. An identity preserved container for storage of a flowable cargo, said container comprising:

a frame supporting an enclosure with a top, bottom, side walls, front wall, and a back wall;

a liner secured to an interior of said enclosure, comprising side panels and funnels panels forming a bin terminating in a centrally located opening in said bottom of said enclosure wherein said liner is made of a material resistant to sticking of flowable cargo to preserve the identity of the cargo;

a plurality of support panels reinforcingly secured to the underside of said funnel panels;

a belly door located in said opening in said bottom of said enclosure wherein said belly door moves between a closed and an open position; and wherein a plurality of rails connect to said support panels.

2. The invention in accordance with claim 1 wherein said liner is made of a non-stick material to promote the flow of the cargo.

3. The invention in accordance with claim 2 wherein said non-stick material is polyboard.

4. The invention in accordance with claim 1 further comprising a releasable sealed hatch in said top of said enclosure to allow for the introduction of the cargo.

5. The invention in accordance with claim 1 wherein said side panels of said liner overlaps said funnel panels of said liner to prevent capture of the cargo between the joint between liner panels.

6. The invention in accordance with claim 1 wherein said side panels of said liner are secured to said interior of said enclosure with fasteners located in periodic recesses in said side panels.

7. The invention in accordance with claim 6 further comprising caps placed over said recesses to prevent retention of the cargo in said recesses.

8. The invention in accordance with claim 1 wherein said belly door is comprised of a first layer of polyboard and a second layer of steel.

9. The invention in accordance with claim 1 wherein said belly door further comprises a rack and spur gear mechanism for moving said belly door between said open and said closed position.

10. The invention in accordance with claim 1 wherein said container is divided into a plurality of compartments, wherein said compartments are divided by a compartment wall.

11. The invention in accordance with claim 1 wherein said container is air-tight.

12. The invention in accordance with claim 1 further comprising cargo and said cargo is grain.

13. The invention in accordance with claim 12 wherein said grain is an identity preserved variety of corn.

14. The invention in accordance with claim 1 wherein said cargo is soybeans.

15. The invention in accordance with claim 1 wherein said cargo is wheat.

16. The invention in accordance with claim 1 wherein said cargo is rice.

17. The invention in accordance with claim 1 wherein said cargo is barley.

18. The invention in accordance with claim 1 wherein said cargo is sorghum.

19. The invention in accordance with claim 1 wherein said container is for storage and transportation of a flowable cargo.

20. The invention in accordance with claim 1 wherein said container is for storage and segregation of a flowable cargo.

21. The invention in accordance with claim 1 wherein said liner is independent of said side walls.

22. The invention in accordance with claim 1 wherein said top is permanent.

23. The invention in accordance with claim 1 wherein a plurality of posts secure the support panels to the bottom of the enclosure.

* * * * *